US007921610B2

(12) United States Patent
Boatwright

(10) Patent No.: US 7,921,610 B2
(45) Date of Patent: Apr. 12, 2011

(54) SYSTEM, METHOD, AND APPARATUS FOR FRAME ASSEMBLY AND BUILDING

(76) Inventor: Garry Boatwright, Amarillo, TX (US)

( * ) Notice: Subject to any disclaimer, the term of this patent is extended or adjusted under 35 U.S.C. 154(b) by 891 days.

(21) Appl. No.: 11/609,527

(22) Filed: Dec. 12, 2006

(65) Prior Publication Data

US 2007/0151196 A1 Jul. 5, 2007

Related U.S. Application Data

(60) Provisional application No. 60/750,970, filed on Dec. 16, 2005.

(51) Int. Cl.
*E04B 7/02* (2006.01)

(52) U.S. Cl. ..... 52/90.1; 52/652.1; 52/653.2; 52/639; 52/643

(58) Field of Classification Search ..... 52/90.1, 52/91.1, 92.1, 92.2, 633, 652.1, 653.1, 653.2, 52/654.1, 656.1, 91.3, 639, 641, 643, 655.1; 135/122, 158

See application file for complete search history.

(56) References Cited

U.S. PATENT DOCUMENTS 872,658 A * 12/1907 Lee ..... 52/92.3
1,170,188 A * 2/1916 Rasmussen et al. ..... 135/149
1,917,440 A * 7/1933 Finkbeiner et al. ..... 297/6
1,951,634 A * 3/1934 Steck ..... 52/643
2,001,215 A * 5/1935 Ruppel ..... 52/653.2
D178,116 S 6/1956 Eberhard
3,177,618 A 4/1965 Jacob
3,196,773 A * 7/1965 Lorenz et al. ..... 454/237
D204,666 S 5/1966 Crawford
3,283,693 A * 11/1966 Howell ..... 454/186
3,296,752 A * 1/1967 Richard ..... 52/70
3,354,590 A 11/1967 Gilroy
3,378,966 A 4/1968 Lindal
3,385,013 A 5/1968 Severson
3,442,057 A * 5/1969 Derr ..... 52/90.1
3,460,297 A 8/1969 Fritz
3,464,167 A * 9/1969 Mason ..... 52/22
3,659,388 A * 5/1972 Sirianni ..... 52/91.1
3,714,746 A * 2/1973 Barlow ..... 52/69
3,771,277 A 11/1973 Rausch et al.
3,785,108 A * 1/1974 Satchell ..... 52/645
3,861,095 A * 1/1975 Eoxworthy ..... 52/91.3
3,862,526 A 1/1975 Loughlin
3,942,290 A 3/1976 O'Sheeran
3,999,338 A * 12/1976 Behan et al. ..... 52/90.1
4,005,556 A 2/1977 Tuomi
4,024,682 A 5/1977 Jamison
4,056,902 A * 11/1977 Ziegler, Jr. ..... 52/73
4,207,714 A 6/1980 Mehls
4,294,051 A * 10/1981 Hughes, Jr. ..... 52/98

(Continued)

*Primary Examiner* — Robert J Canfield
*Assistant Examiner* — Brent W Herring
(74) *Attorney, Agent, or Firm* — Bracewell & Giuliani LLP

(57) ABSTRACT

An A-frame assembly for constructing a building comprises only five major components that are formed from square, galvanized steel hollow tubing. These components include corner braces, side braces, a top brace, beams, and straight tubing. The straight tubing interconnects the other components to form a triangular frame assembly. The corner braces are secured with concrete footings or a complete foundation. A number of the frame assemblies are arrayed to form the basis of a structure. The frame assemblies are spaced apart from each other, joined with additional square tubing, and include an attic space and service spaces between the corner braces. A roofing structure is secured to the joined frame assemblies to complete the structural phase of the assembly.

20 Claims, 19 Drawing Sheets

U.S. PATENT DOCUMENTS

| | | | | |
|---|---|---|---|---|
| 4,530,194 | A * | 7/1985 | Linton et al. | 52/712 |
| 5,076,031 | A * | 12/1991 | Hancock | 52/63 |
| 5,761,863 | A * | 6/1998 | Sutt et al. | 52/272 |
| 5,966,890 | A * | 10/1999 | Inman | 52/653.2 |
| 6,173,726 | B1 * | 1/2001 | Talmadge | 135/144 |
| 6,321,501 | B1 * | 11/2001 | Ignash | 52/645 |
| 6,470,632 | B1 * | 10/2002 | Smith | 52/92.2 |
| 6,691,488 | B2 * | 2/2004 | Branson | 52/745.01 |
| 6,715,255 | B2 * | 4/2004 | Schipani et al. | 52/646 |
| 6,772,780 | B2 * | 8/2004 | Price | 135/131 |
| 6,857,246 | B2 * | 2/2005 | Erbetta et al. | 52/653.2 |
| 6,892,503 | B1 * | 5/2005 | Kang | 52/653.2 |
| 7,168,439 | B2 * | 1/2007 | Patel et al. | 135/131 |
| 7,325,362 | B1 * | 2/2008 | Rowland | 52/93.2 |
| 7,389,785 | B2 * | 6/2008 | Loudermilk et al. | 135/121 |
| 7,475,517 | B2 * | 1/2009 | Kawai et al. | 52/702 |
| 2003/0029490 | A1 * | 2/2003 | Price et al. | 135/131 |
| 2006/0213144 | A1 * | 9/2006 | Kessler et al. | 52/633 |

* cited by examiner

SYSTEM, METHOD, AND APPARATUS FOR FRAME ASSEMBLY AND BUILDING

This application claims priority to and the benefit of U.S. Provisional Patent Application No. 60/750,970, filed on Dec. 16, 2005, and is incorporated herein by reference.

BACKGROUND OF THE INVENTION

1. Technical Field

The present invention relates in general to a building frame and dwelling built thereon and, in particular, to an improved system, method, and apparatus for an A-frame assembly and dwelling.

2. Description of the Related Art

In the prior art, a wide variety of A-frame building designs have been proposed. However, the need persists for considerable improvement in the art. Although one of the primary advantages thought to be provided by the A-frame building design concept is that of simplicity and therefore economy, many prior building designs of this type have in fact been complicated and costly. One characteristic of the type of complexity that is often found in prior art A-frame building designs involves the use of separate frame and roof and wall members. This necessitates very accurate construction of the frame in order that the roof and wall members will properly fit together. Many prior art A-frame building designs have also employed relatively complicated means of interconnecting either the frame or the roof and wall members to the underlying floor structure. Thus, an improved design for an A-frame assembly and dwelling would be desirable.

SUMMARY OF THE INVENTION

One embodiment of a system, method, and apparatus for forming an A-frame assembly for use in constructing a building, dwelling, or other structure is disclosed. The assembly comprises only five major components, all of which may be formed from square, galvanized steel hollow tubing. The five major components include corner braces, side braces, a top brace, beams, and straight tubing. The straight tubing interconnects the other components to form a triangular frame assembly. The corner braces may be secured with concrete footings or a complete foundation.

A number of the frame assemblies are arrayed to form the basis of a structure such as a dwelling. The frame assemblies are spaced apart from each other and joined with additional square tubing. The frame assemblies also may include an attic space adjacent the top brace, and service spaces in volumes formed by the corner braces. A roofing structure is secured to the joined frame assemblies to complete the structural phase of the assembly. The building may be finished out with numerous exterior facades and interior appointments.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
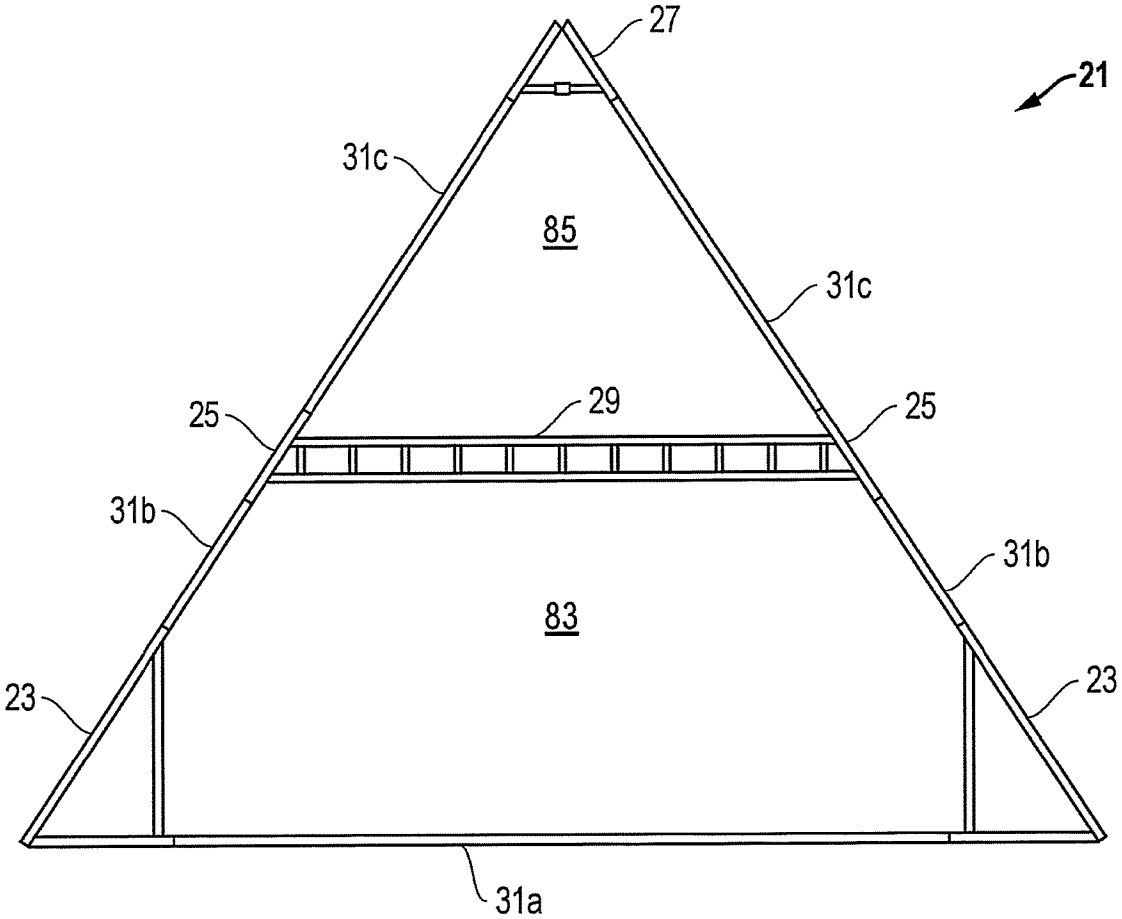
FIG. 1 is a front view of one embodiment of a frame assembly constructed in accordance with the present invention.
Figure 2:
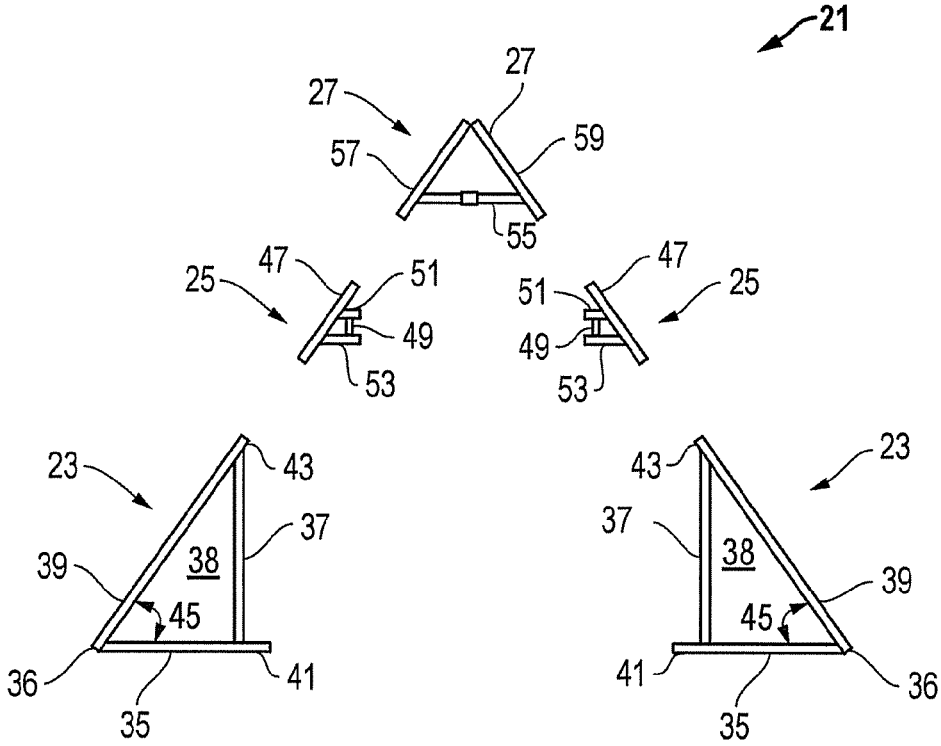
FIG. 2 is an exploded front view of the frame assembly of FIG. 1 showing some of the components thereof and is constructed in accordance with the present invention.

Referring to FIGS. 1 and 2, one embodiment of a system, method, and apparatus for forming a truss or frame assembly 21 (e.g., an A-frame assembly) for use in constructing a building, dwelling, or other structure is shown. Assembly 21 comprises only five major components, all of which are formed from square, galvanized steel hollow tubing in one embodiment. The five major components include corner brace 23, side brace 25, top brace 27, beams 29, and straight tubing 31.

The straight tubing 31 is cut to different lengths (see, e.g., lower, middle, and upper pieces 31*a*, 31*b*, 31*c*) and interconnects the other four components to form the triangle-shaped frame assembly 21. The left and right corner braces 23 and side braces 25 are identical, respectively, but oriented in opposite directions. Top brace 27 may be triangular as shown, or rounded as shown in the embodiment shown as top brace 33 in FIG. 3. In one embodiment, the assembled components are joined together with fasteners (e.g., screws), welds, or other techniques known in the art.

As best shown in FIG. 2, one embodiment of each corner brace 23 comprises three welded pieces of galvanized steel tubing, including a horizontal 35, vertical 37, and diagonal 39 to form a triangular substructure. Horizontals 35 have ends 41 that extend inward toward each other beyond their respective intersections with verticals 37 by about six inches. Likewise, diagonals 39 have ends 43 that extend above and inward beyond their respective intersections with verticals 37. In one embodiment, horizontal 35 and diagonal 39 form a reference angle 45 of about 56 to 60 degrees, and diagonals 39 are about six feet long. Floor tubing piece 31*a* may be used to temporarily erect the frame assembly 21 and then removed, or left in place to complete the building if equipped with raised flooring (e.g., wood) or a crawl space.

One embodiment of each side brace 25 comprises four welded pieces of galvanized steel tubing, including a diagonal 47, vertical 49, and top and bottom 51, 53, respectively, extending between diagonal 47 and vertical 49. Diagonal 47 is the longest piece (about two to three feet long) of the four pieces, and extends approximately equidistant beyond both top 51 and bottom 53. Top 51 is the shortest piece of the four pieces, but it and bottom 53 extend inward beyond their respective intersections with vertical 49. Bottom 53 is slightly longer than vertical 49. When assembled to form frame assembly 21, diagonals 47 and 39 are aligned and parallel, top 51, bottom 53, and horizontal 35 are parallel, and verticals 49, 37 are parallel. In an alternate embodiment, side braces 25 may be constructed without verticals 49. In another embodiment, the upper ends of diagonals 47 may be extended (e.g., several feet) to reduce the length requirement of straight tubing 31*c*.

One embodiment of top brace 27 resembles the letter capital letter "A" (FIG. 2) and comprises three welded pieces of galvanized steel tubing, including a horizontal 55 and diagonals 57, 59. Each diagonal 57, 59 is roughly three feet long. In the alternate embodiment of FIG. 3, top brace 33 is semicircular and comprises a single piece of galvanized steel tubing that is bent and formed to somewhat resemble a letter "C" as shown.

Figure 16:
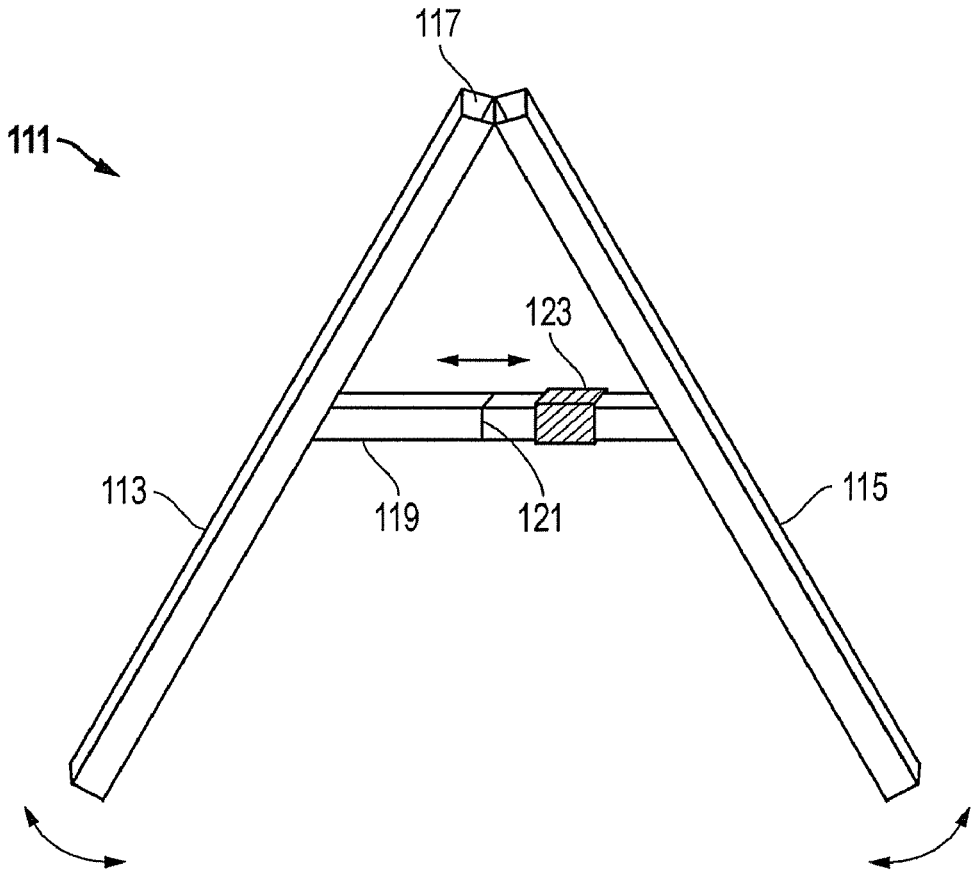
FIG. 16 is an isometric view of another embodiment of a top brace constructed in accordance with the invention.

Still another embodiment is illustrated in FIG. 16 as top brace 111. Top brace 111 comprises diagonals 113, 115 that are welded to form a "hinge" edge of contact 117. Ventilation for a frame assembly is provided through the hollow ends of diagonals 113, 115. The ends of a solid horizontal 119 is welded in place between diagonals 113, 115, and then cut 121 after installation to permit a limited range of movement (see arrows) during the assembly process. After top brace 111 is installed on a frame assembly, a sleeve 123 is moved over the cut 121 such that the sleeve 123 straddles both cut pieces of horizontal 119. The sleeve 123 is then welded in place to secure the assembly and prevent any additional movement of the components of top brace 111.

Again referring to FIG. 3, the beam 29 comprises upper and lower horizontals 61, 63, respectively, that are welded to a plurality of short verticals 65, the number of which depends on the application. Upper horizontal 61 is slightly shorter than lower horizontal 63, and beam 29 is about 13 feet long in the embodiment shown. Verticals 65 are each about seven inches long. When assembled to form frame assembly 21, one beam 29 extends between two side braces 25 such that upper horizontal 61 inserts into tops 51, and lower horizontal 63 inserts into bottoms 53.

In one embodiment, the "larger" pieces and components that receive the smaller pieces and components are 2½-inch, 14-gage, and 2¼-inch, 12-gage tubing, respectively. For example, upper and lower horizontals 61, 63 and tubing 31 comprise 2¼-inch tubing, while the tops 51, bottoms 53, top braces 27, 33, and diagonals 39, 47 comprise 2½-inch tubing. Thus, the overall frame assembly 21 is formed by sliding the smaller pieces/components into the larger hollow tube pieces/components and then, optionally, securing them together via welding or fasteners.

Figure 5:
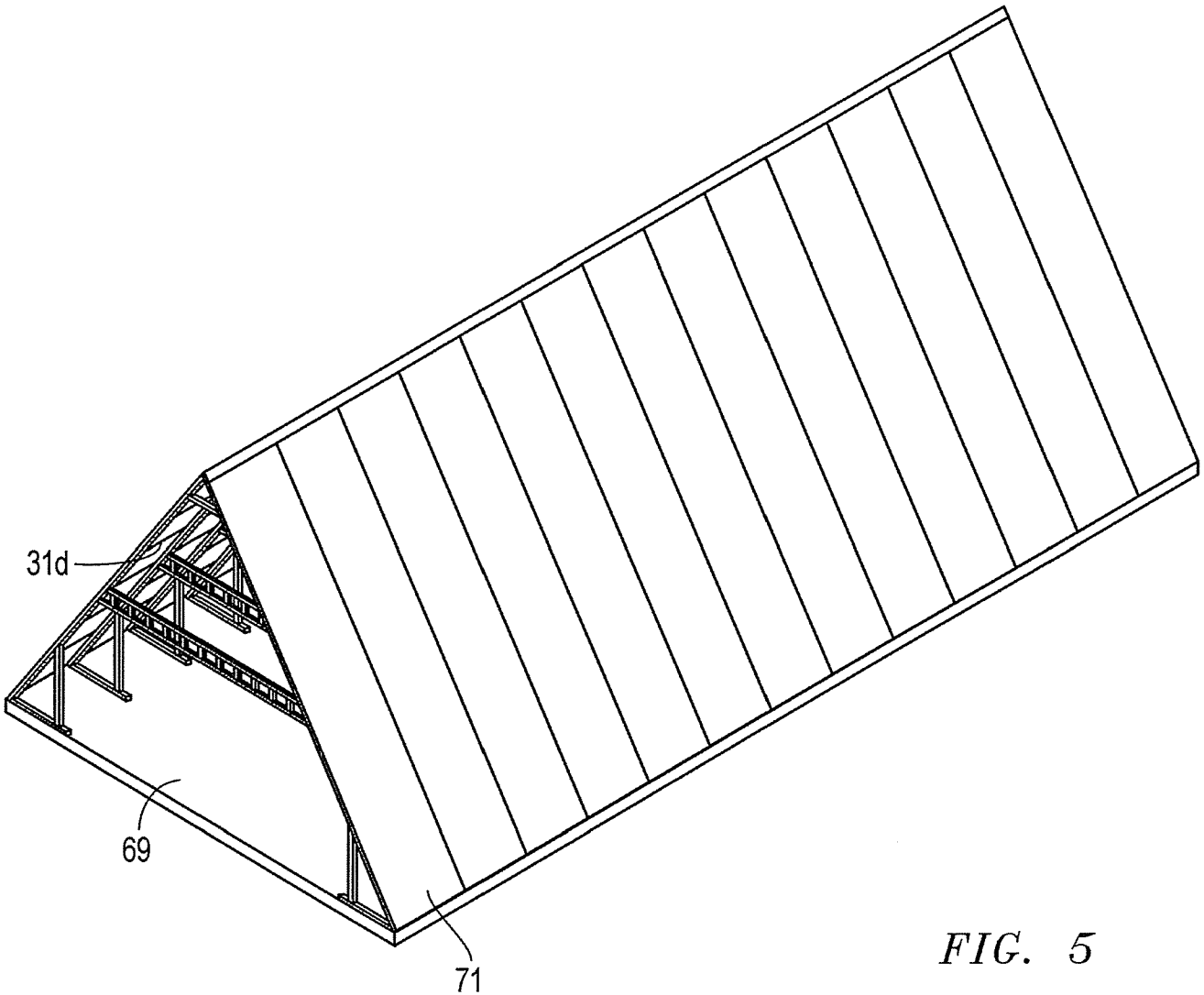
FIG. 5 is an isometric view of the substructure of FIG. 4 having a foundation and a roof structure and is constructed in accordance with the present invention.
Figure 12:
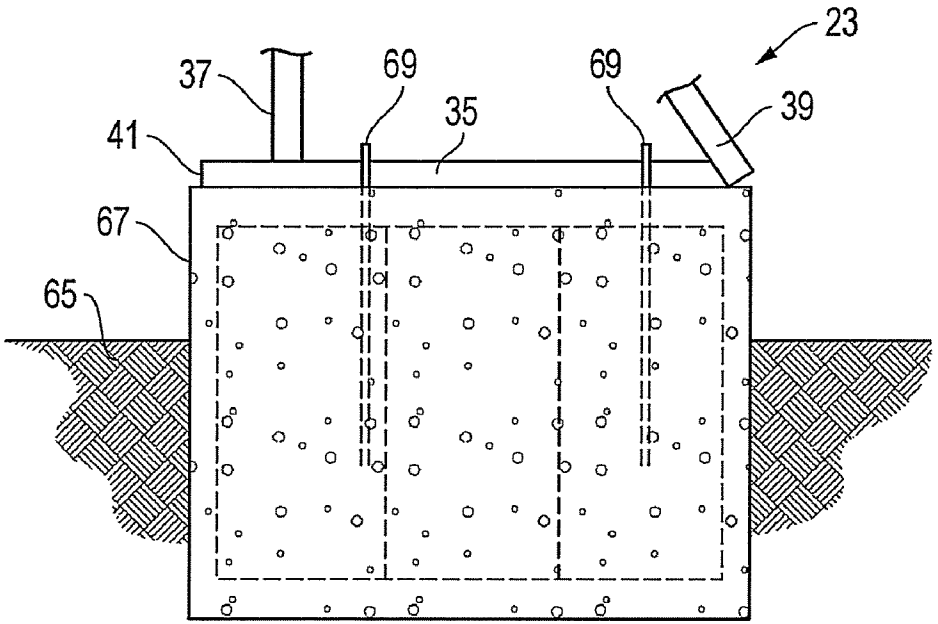
FIGS. 11 and 12 are front and side views, respectively, of one type of foundation footing utilized by, for example, the frame assembly of FIG. 1, and is constructed in accordance with the present invention.
Figure 11:
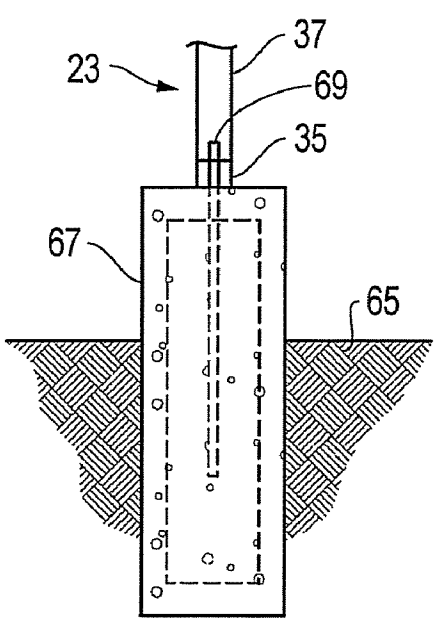

Referring now to FIGS. 11 and 12, corner braces 23 of the frame assembly 21 may be secured to the earth 65 with, for example, a concrete footing 67. In the embodiment shown, footing 67 may comprise a rectangular block of concrete, about two-thirds of which is buried in earth 65 depending on the application. One or more rods 69 extend from footing 67 as shown and may be secured (e.g., bolted) to horizontal 35 to attach the frame assembly 21 to the earth 65. A large, conventional foundation 69 (FIG. 5) that extends beneath the entire structure may be used in place of footings 67 at a higher cost. For ease of reference, any type of underlying support structure (e.g., footing, foundation, etc.) may be referred to as a foundation.

Figure 4:
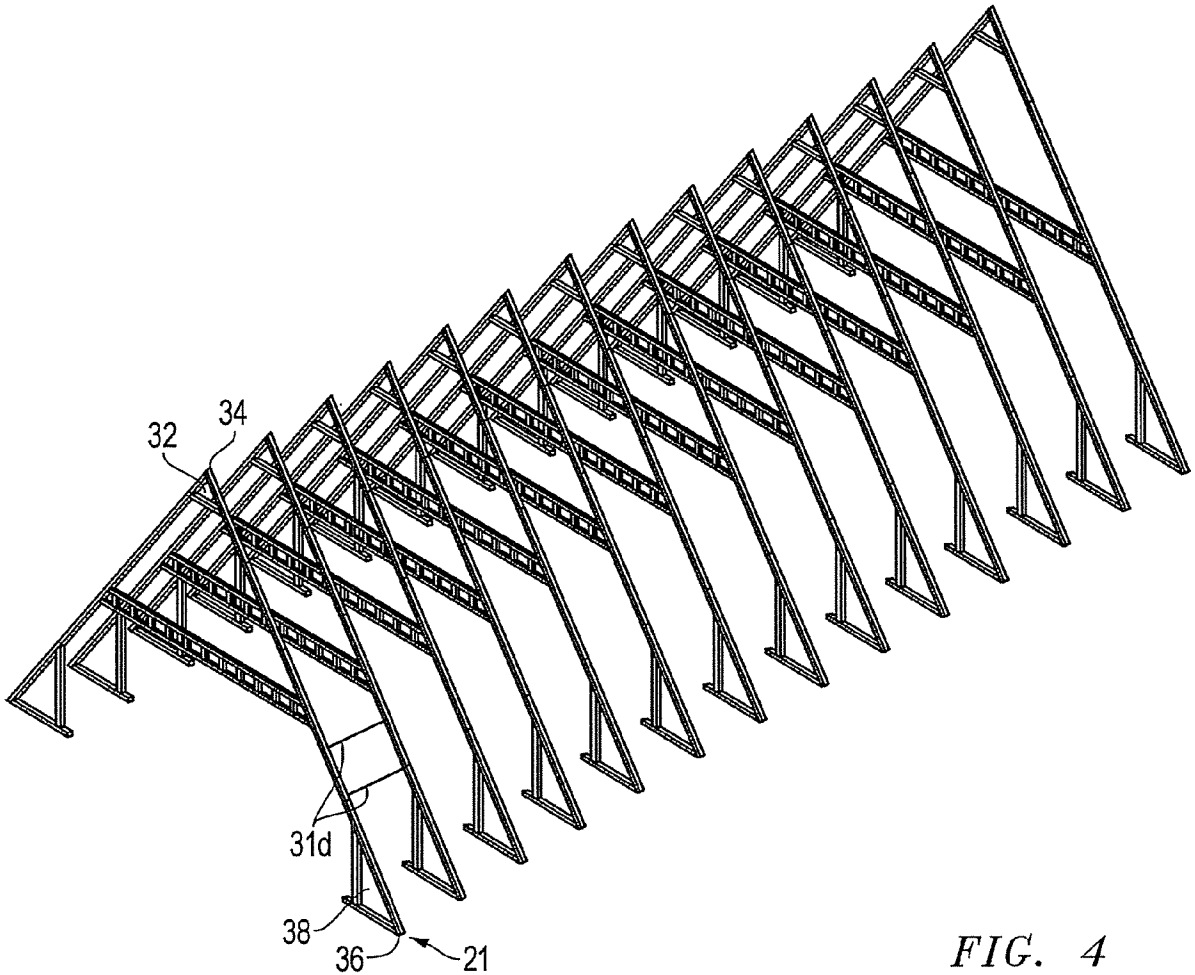
FIG. 4 is an isometric view of a plurality of the frame assemblies of FIG. 1 arrayed to form a substructure of a building and is constructed in accordance with the present invention.
Figure 13:
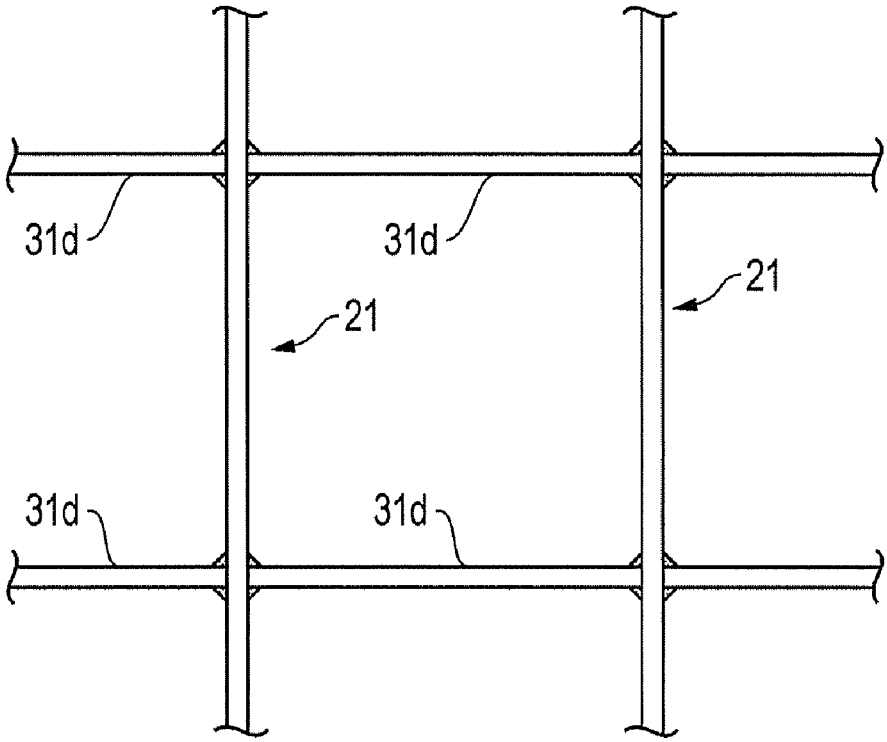
FIG. 13 is a partial side view of one embodiment of a roofing framework utilized to join the substructure of FIG. 4 and is constructed in accordance with the present invention.
Figure 20:
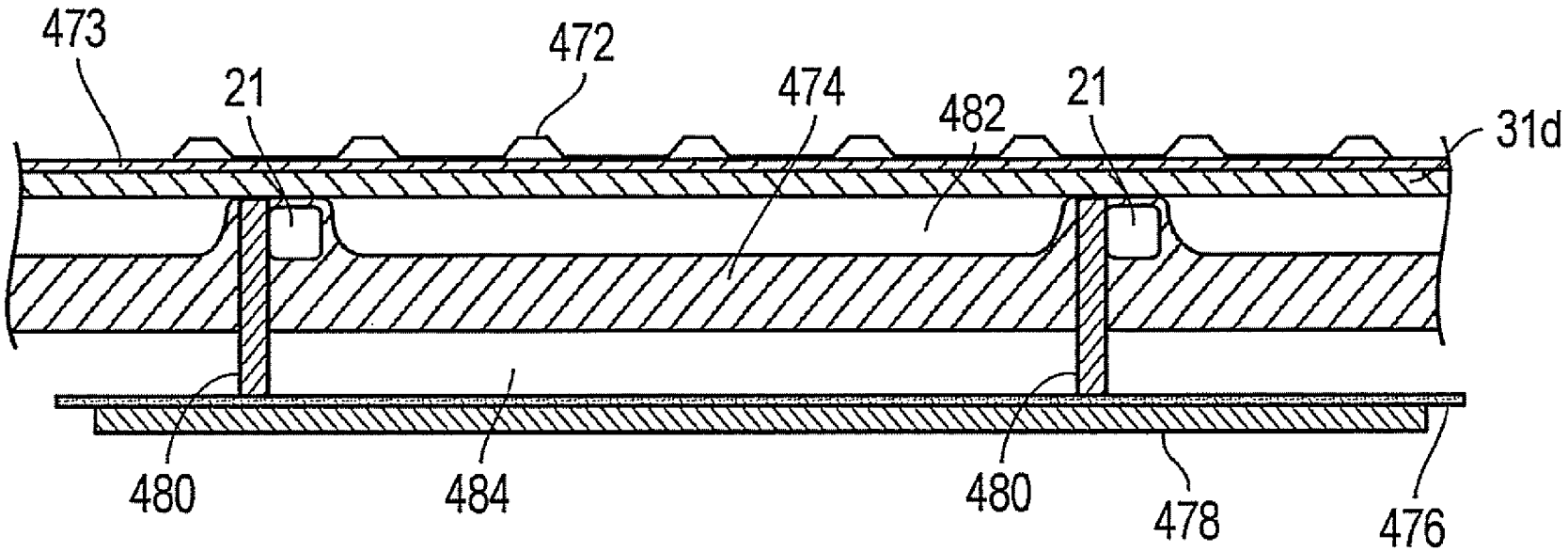
FIG. 20 is a sectional view of another embodiment of a roof and ceiling configuration constructed in accordance with the present invention.

As shown in FIG. 4, a plurality of the frame assemblies 21 may be used to form the basis of a structure such as a building, dwelling, etc. The frame assemblies 21 are spaced apart from each other in parallel about four feet apart, depending on the application. In one embodiment, the individual frame assemblies 21 are then joined (e.g., welded) together with, for example, more tubing pieces 31*d* or braces (FIG. 13), which also may function as purlin, that are spaced apart in parallel between frame assemblies 21. For ease of understanding and simplified illustration, only six tubing pieces 31*d* (e.g., each of which is less than about four feet in length) are shown in FIG. 4, although many more would be required as understood by one skilled in the art. Alternatively, the braces 31*d* may comprise extended lengths that are joined to the tops of the frame assemblies 21 as shown in FIG. 20.

Frame assemblies 21 also may include an attic space 32 that is defined at an upper end (e.g., adjacent top brace 27) of each frame assembly 21. Holes or notches 34 are formed at or near the upper ends of diagonals 59 to ventilate the continuous hollow length of the assembled square tubing extending from top brace 27 to corner brace 23. In addition, as shown in FIG. 2, the lower ends of diagonals 39 on corner braces 23 have holes or notches that act as exhaust vents 36 for the same purposes. The volume defined between the open interiors 38 of adjacent corner braces 23 also provide a natural service space for auxiliary components, utilities, etc., that may be required or useful for the building.

Figure 17:
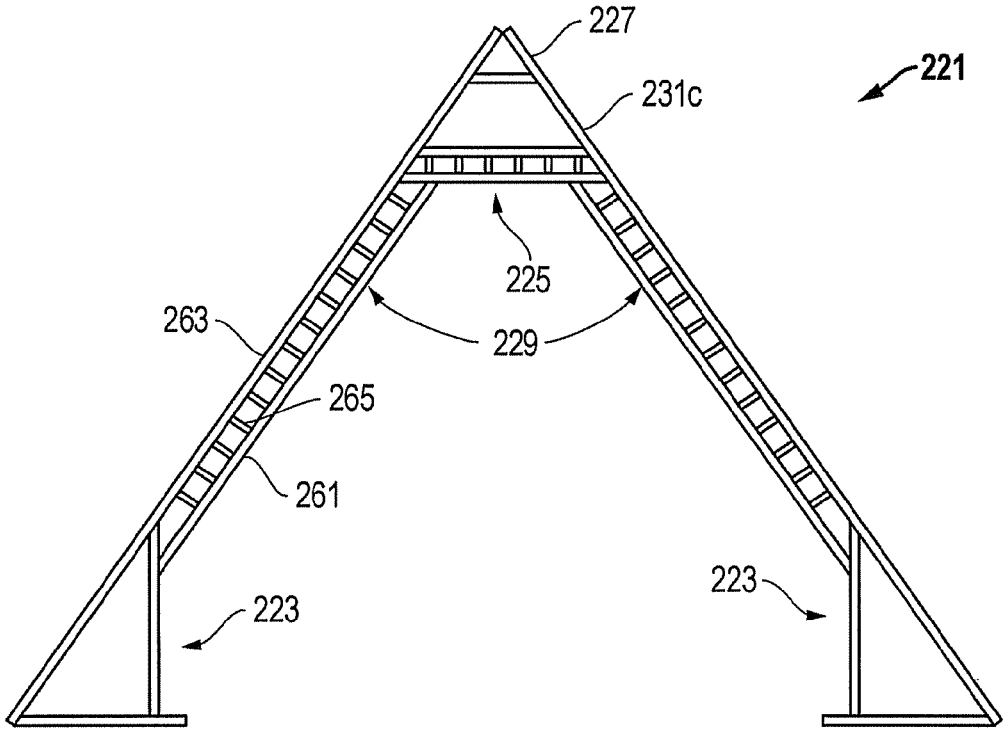
FIG. 17 is a front view of another embodiment of a frame assembly constructed in accordance with the present invention.
Figure 18:
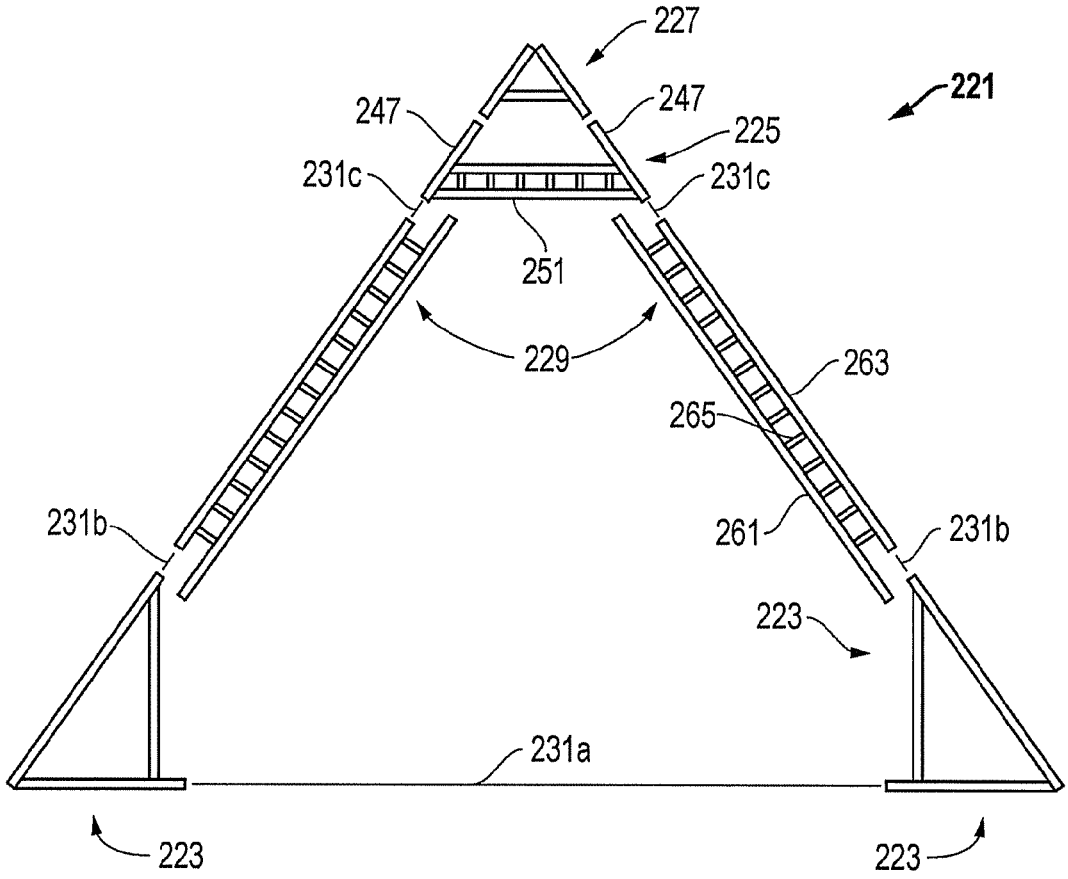
FIG. 18 is a front exploded view of the frame assembly of FIG. 17 and is constructed in accordance with the present invention.

Referring now to FIGS. 17 and 18, another embodiment of a frame assembly 221 is shown having a much higher interior ceiling than the other embodiments. Like assembly 21, assembly 221 comprises only five major components, all of which are formed from square, galvanized steel hollow tubing in one embodiment. The five major components include mirror-image corner braces 223, an intermediate brace 225, a top brace 227, beams 229, and straight tubing 231. In this embodiment, beams 229 form the primary structural support and comprise inner and outer longitudinals 261, 263, respectively, that are welded to a plurality of short laterals 265. When assembled to form frame assembly 221, two beams 229 extend diagonally between respective ones of the two corner braces 223 and the one intermediate brace 225. Intermediate brace 225 differs from the previously-described side braces in that it incorporates a horizontal beam feature 251 (FIG. 18) extending between two diagonals 247.

The straight tubing 231 may be cut to appropriate lengths (not drawn to scale, but see, e.g., lower, middle, and upper pieces 231*a*, 231*b*, 231*c*) to interconnect the other four components to form the triangle-shaped frame assembly 221. The assembled components may be joined together with fasteners, welds, or other techniques. The components are substantially similar in construction and assembly to those described above for other embodiments, some with slight modifications to facilitate assembly as shown.

Figure 3:
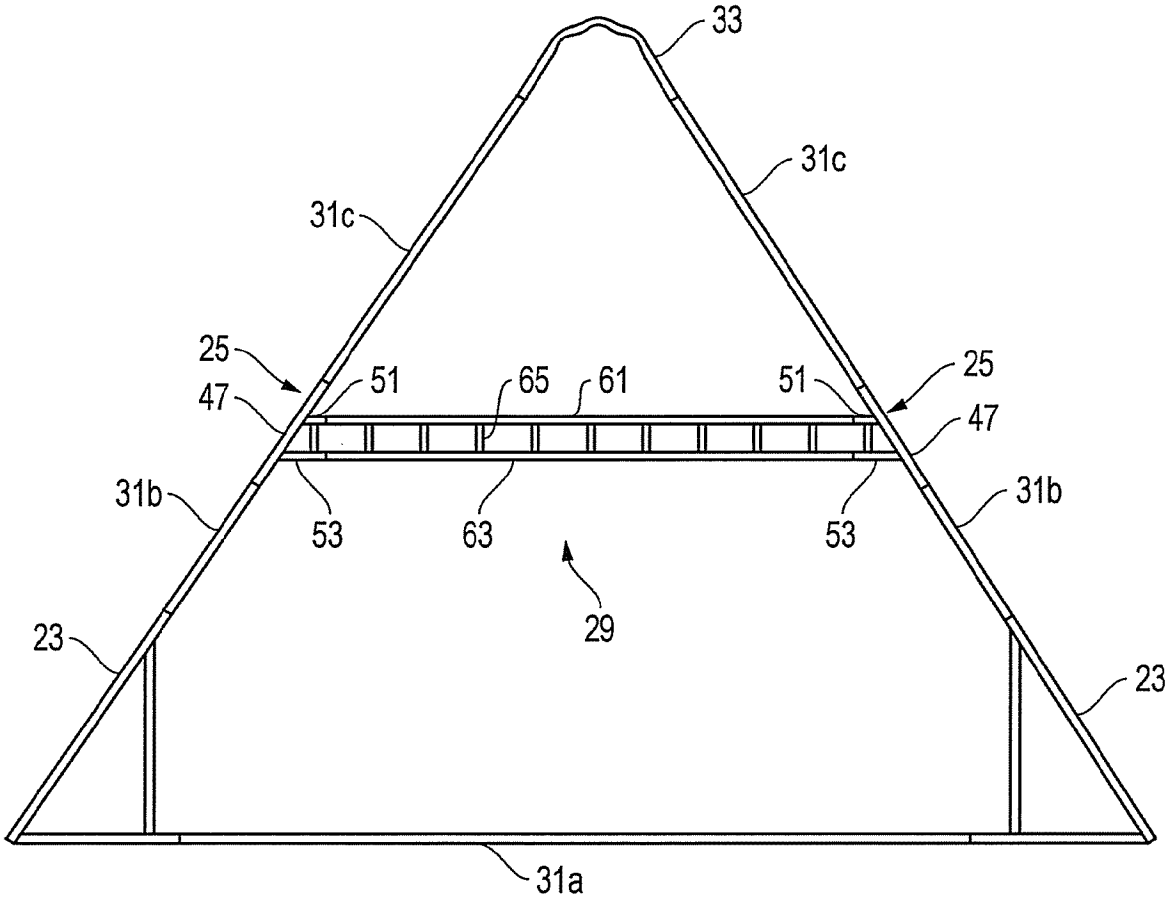
FIG. 3 is a front view of an alternate embodiment of a frame assembly constructed in accordance with the present invention.
Figure 19:
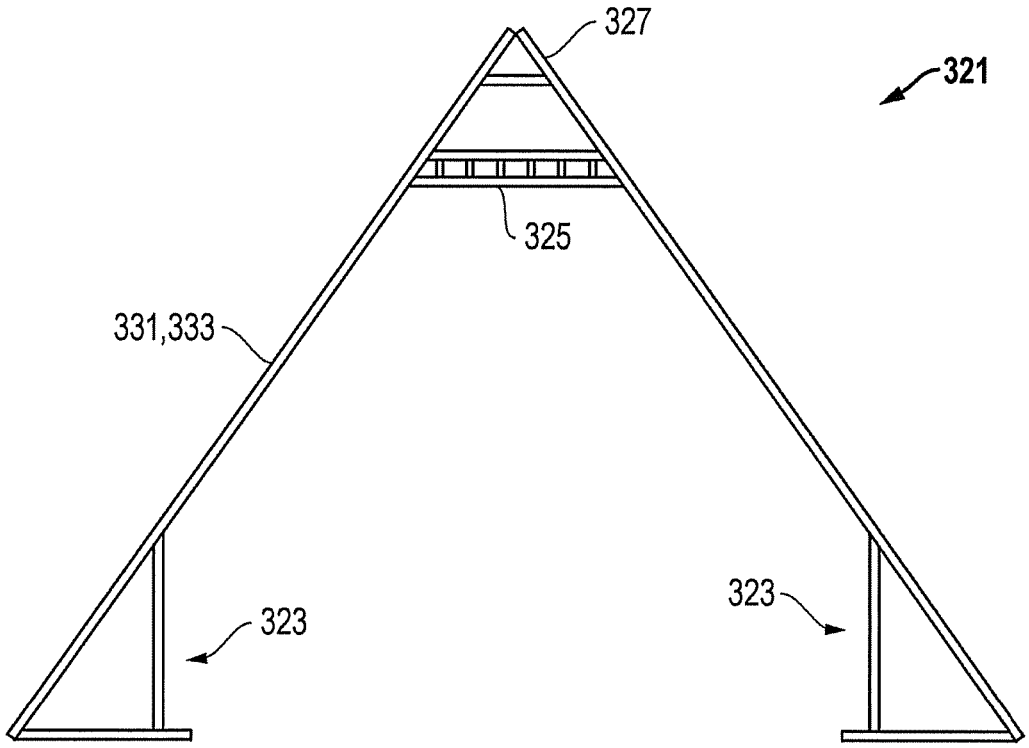
FIG. 19 is a front view of still another embodiment of a frame assembly constructed in accordance with the present invention.

Still another embodiment of a frame assembly 321 is shown in FIG. 19 and is a hybrid of the previous embodiments. Frame assembly 321 also comprises five major components, including corner braces 323, an intermediate brace 325, a top brace 327, and two sizes of straight tubing 331, 333 (e.g., 2¼-inch and 2½-inch tubing). Alternatively, intermediate brace 325 may be replaced with side braces and a beam as shown in FIGS. 1-3. In this embodiment, long pieces of the smaller tubing 331 are located inside (i.e., an inner sleeve) the outer larger tubing 333 (i.e., an outer sleeve) to form a resilient structural support. The straight tubing 331, 333 extends diagonally between the two corner braces 323 and the one intermediate brace 325, and the smaller tubing 331 may extend all the way to the top brace 327. The components are substantially similar in construction and assembly to those described above for other embodiments, some with slight modifications to facilitate assembly as shown.

Figure 15:
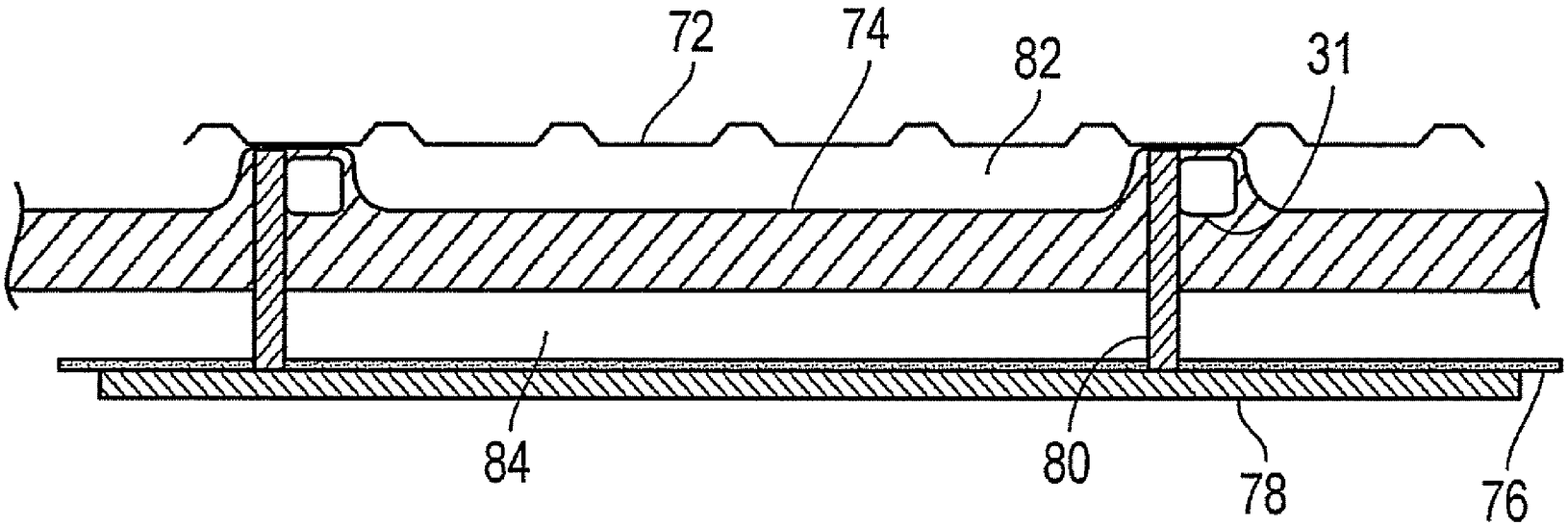
FIG. 15 is a sectional view of one embodiment of a roof and ceiling configuration constructed in accordance with the present invention.

A roofing structure, such as panels 71 (FIG. 5), may be joined to the array of joined frame assemblies 21 to complete the assembly. In one embodiment (FIG. 15), the roof comprises an outer layer of roof material 72 (e.g., 26-gage corrugated metal panels), insulation 74 (e.g., 3-inch pressed foam, 6-inch fiber insulation, spray-in cellulose, etc.), a vapor barrier 76 (e.g., plastic sheeting), and an interior ceiling 78 (e.g., 1×6-inch redwood, cedar, etc., tongue and groove lumber). One or more air spaces 82, 84 are provided between the insulation 74 and roof material 72 and/or vapor barrier 76, respectively. Partitions 80 (e.g., 2×8, 2×10, 2×12-inch, etc., wood lumber) are joined to the frame assemblies and/or bracing (e.g., bracing perpendicular to the roofing components and parallel to each other) to reduce vibration and act as a sound barrier for noise from rain, hail, etc., that would otherwise be transmitted to the interior of the building. This roof design also advantageously insulates and blocks 97% of the energy radiated to or from the buildings.

Referring now to FIG. 20, another embodiment of a roofing and ceiling configuration is shown. The roof may comprises an outer layer of panels 472 mounted to the straight tubing bracing 31*d* (also used as purlin). In this embodiment, bracing 31 is located exterior to the frame assemblies 21. This version further includes a solar reflective material 473 (e.g., A-foil), insulation 474, a vapor barrier 476, and an interior ceiling 478. One or more air spaces 482, 484 are provided between the insulation 474 and roof material 472 and/or vapor barrier 476, respectively. Partitions 480 (e.g., 2×8 or 2×10-inch wood lumber) are joined to the frame assemblies and/or bracing. Other exemplary features, options, and advantages of this configuration are described above for other embodiments.

Figure 6:
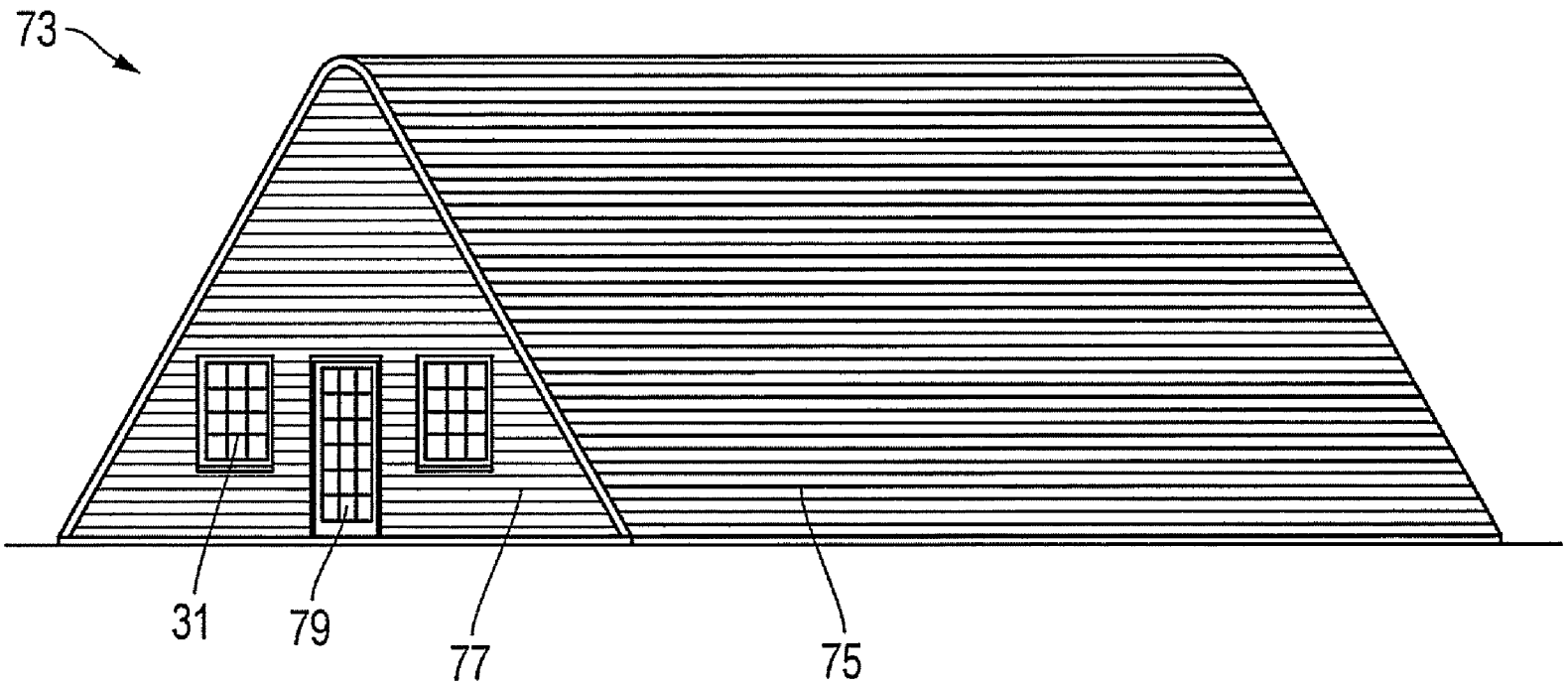
FIG. 6 is an isometric view of one embodiment of a building constructed in accordance with the present invention.

Referring now to FIG. 6, one embodiment of a structure 73 that may be formed based on the foregoing description of present invention is shown. Structure 73 includes roofing 75, and only two (one shown) vertical end walls 77 that are used for structural support. No other vertical walls are used in conjunction with (e.g., beneath) the sloped roofing 75 other than end walls 77 for structural support of the building. End walls 77 may include one or more doors 79 and windows 81. The interior of structure 73 may be subdivided with one or more partitioned interior rooms (not shown), depending on the application. For example, the beams 29 (FIG. 1) of structure 73 may be interconnected and paneled to form a ceiling/floor for a lower room 83 and an attic or second floor 85.

Figure 14:
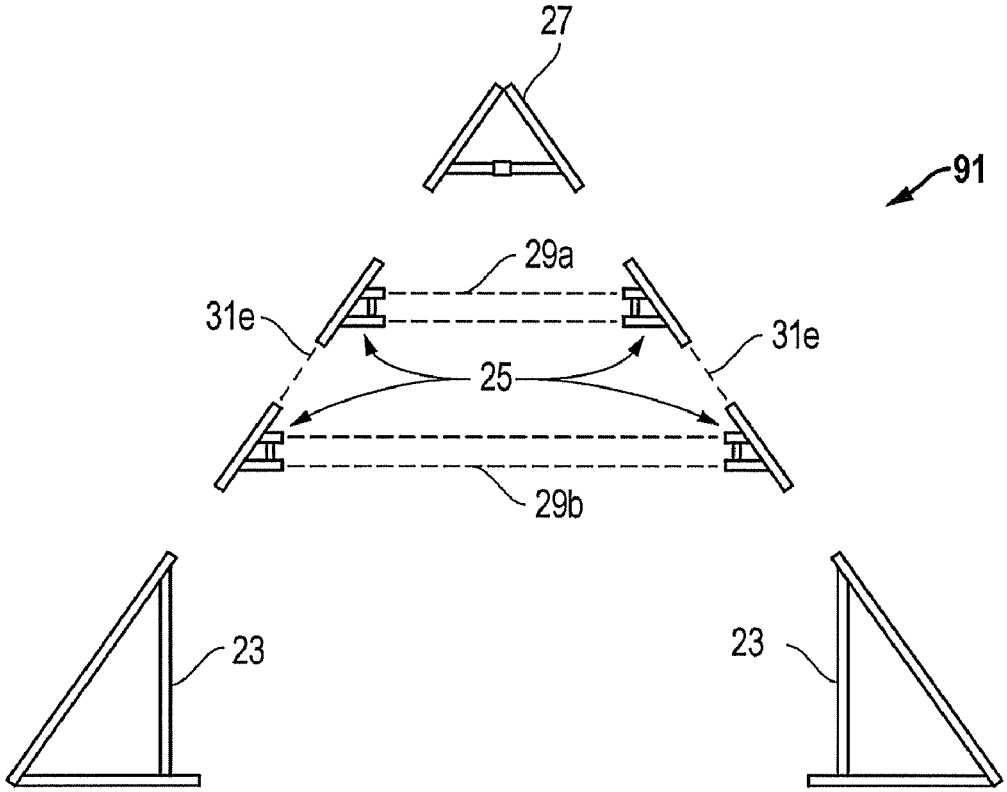
FIG. 14 is an exploded front view of an embodiment a frame assembly utilized by the buildings of FIGS. 7-10 showing some of the components thereof and is constructed in accordance with the present invention.

FIGS. 7-10 illustrate a few of the various other embodiments of larger and/or more elaborate structures and buildings that may be constructed in accordance with the present invention. These designs may utilize a slightly modified version of a frame assembly 91 (FIG. 14) having four side braces 25, an extra set of tubing 31*e* extending therebetween, and an additional, longer beam 29*b* extending horizontally between the two extra side braces 25 to provide a second floor. These structures are otherwise identical to the frame, assembly, and design described above, such as an attic space (e.g., a third level) above the second floor beam 29*a*.

Figure 7:
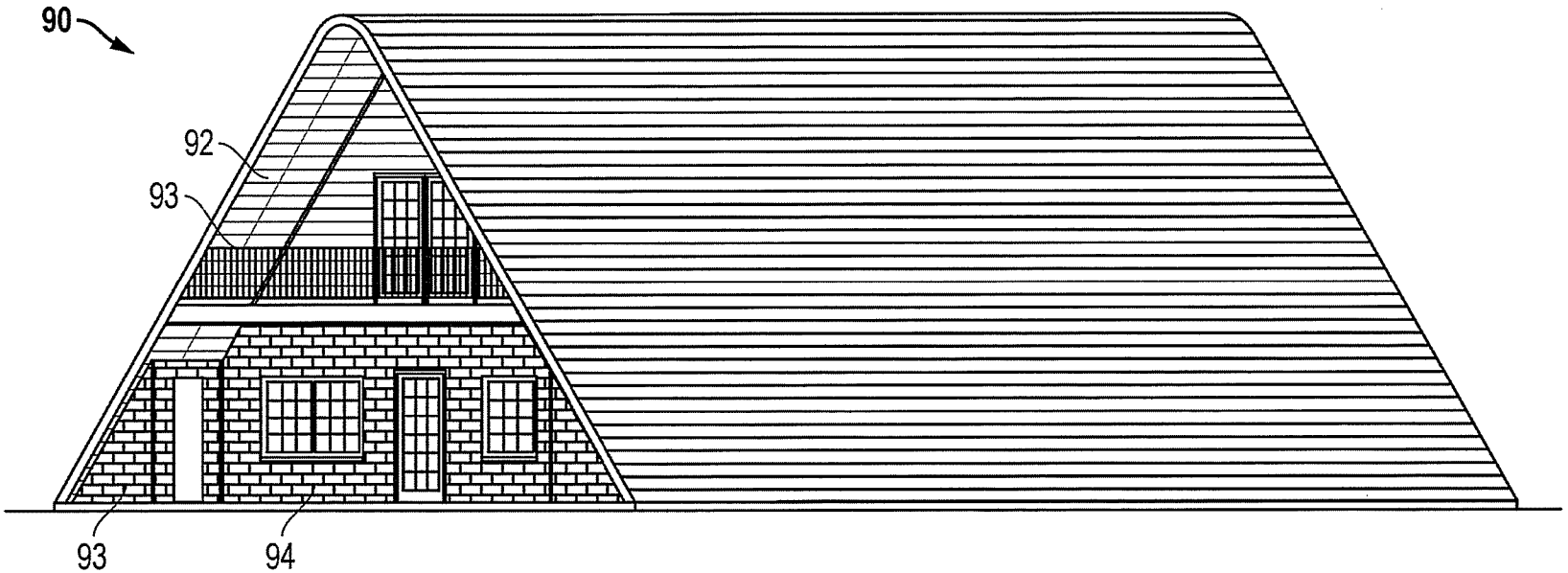
FIG. 7 is an isometric view of a second embodiment of a building constructed in accordance with the present invention.

For example, FIG. 7 shows a design 90 with a second floor end balcony 93, brick detail that may be fastened directly to the outermost frame assembly 21, and a pair of outdoor, triangular prism-shaped closets 95. In this embodiment, the closets 95 are shown formed under an awning 92 that provides cover for the windows and doors in the recessed vertical end wall 94. The awning 92 adds thermal efficiency to the design and may, in one embodiment, extend from vertical end wall 94 by 8 to 12 feet.

Figure 8:
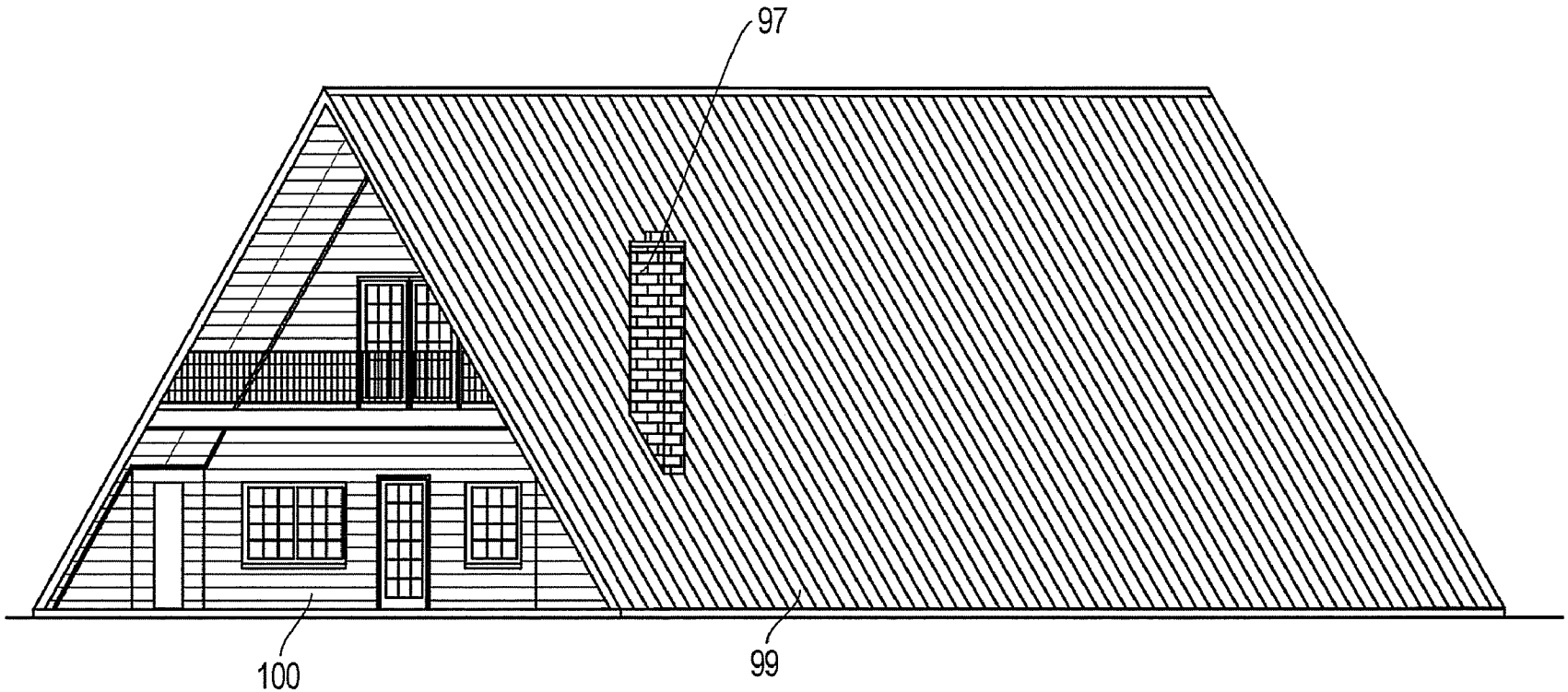
FIG. 8 is an isometric view of a third embodiment of a building constructed in accordance with the present invention.
Figure 9:
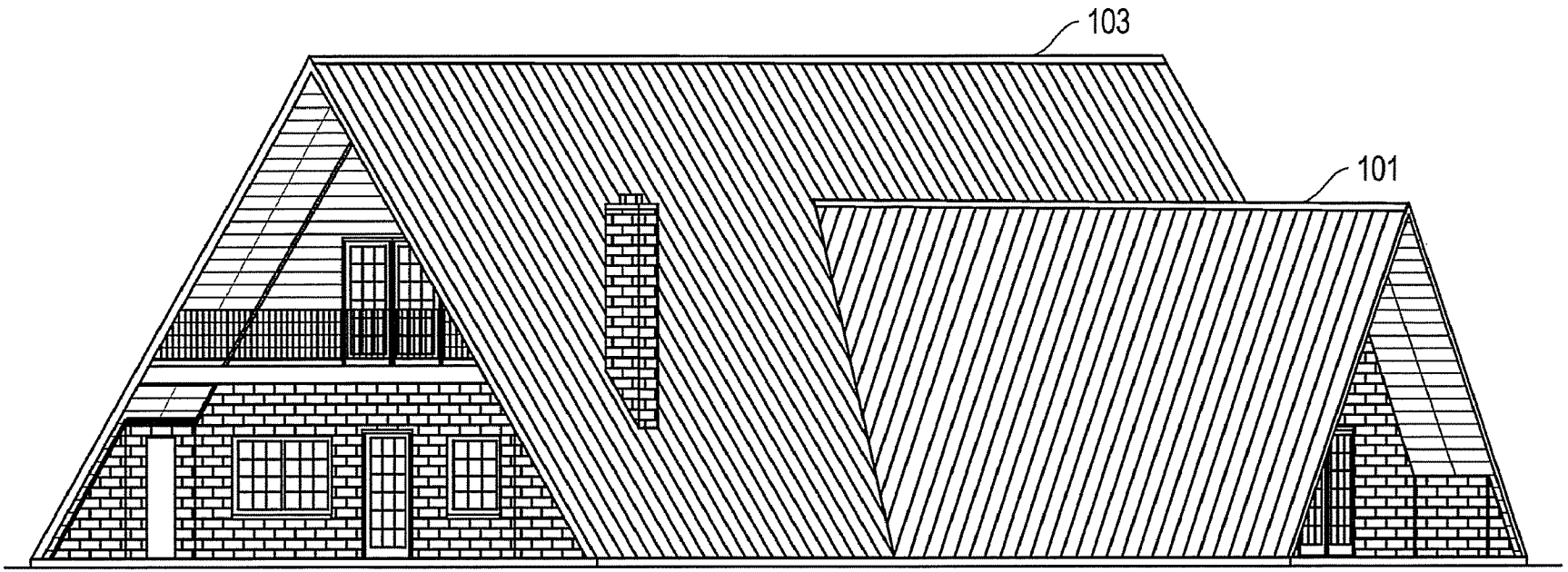
FIG. 9 is an isometric view of a fourth embodiment of a building constructed in accordance with the present invention.
Figure 10:
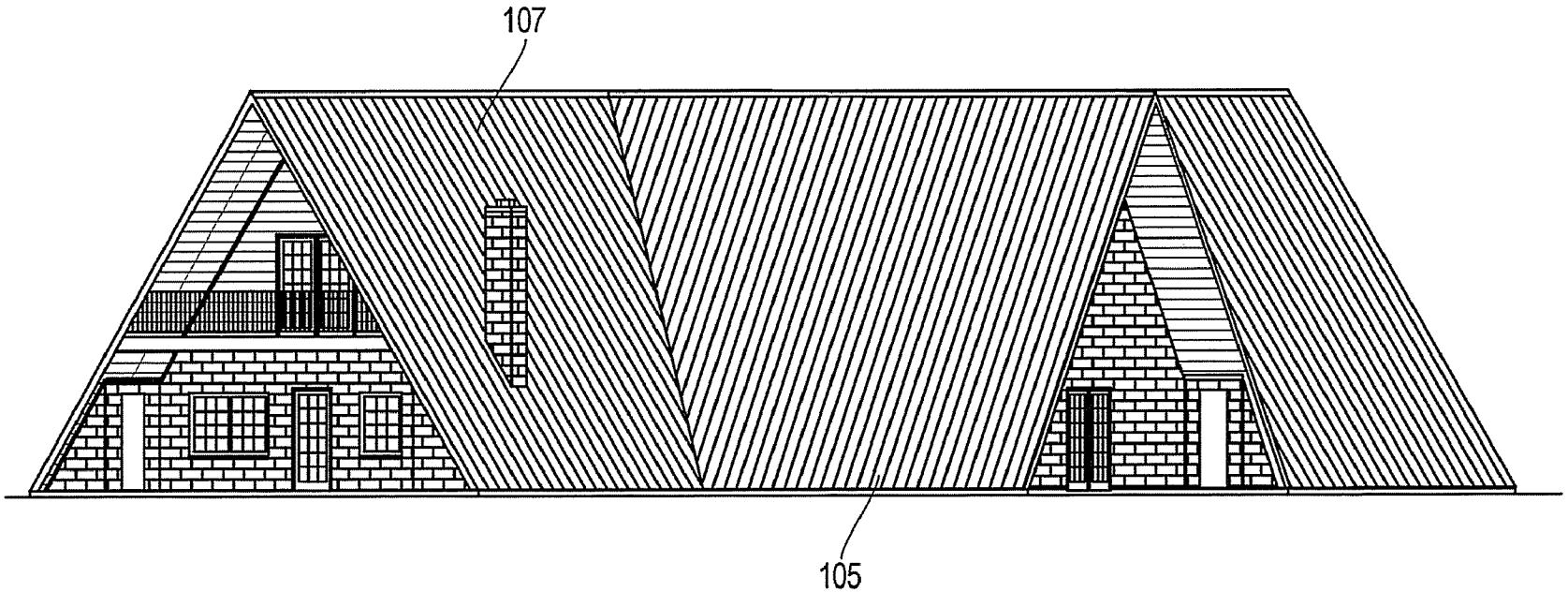
FIG. 10 is an isometric view of a fifth embodiment of a building constructed in accordance with the present invention.

FIG. 8 illustrates a chimney 97, an alternate type of roofing 99, and paneling 100 on the exterior vertical end walls. FIG. 9 depicts one embodiment of a one-story side room 101 that extends orthogonally from the main building 103. The framing for side room 101 is added after the framing for main building 103 is constructed, and then appropriate portions of that framing are removed for installation of the framing for side room 101. FIG. 10 depicts an embodiment of a two-story side room 105 that extends from the main building 107. Advantageously, the addition of one or more side rooms to any of the embodiments of the main buildings significantly increases (e.g., more than doubles) the strength of the overall structure.

While the invention has been shown or described in only some of its forms, it should be apparent to those skilled in the art that it is not so limited, but is susceptible to various changes without departing from the scope of the invention. For example, only a few examples of the present invention have been shown and described. Many other embodiments of the present invention may be contemplated as would be understood by one skilled in the art. For example, interior structural walls with steel framing may be added to further increase the strength of the buildings. All of the above described elements, features, and benefits are interchangeable among and applicable to the various embodiments. Moreover, the designs of the present invention are also easily and quickly assembled and installed, and have an extremely low cost per square foot of construction.

What is claimed is:

1. A frame assembly, comprising:

a pair of corner braces;

a pair of side braces, each of the side braces being associated with and located adjacent and above respective ones of the corner braces;

a beam extending horizontally between and connecting the side braces;

a top brace located adjacent and above the side braces and the beam opposite the corner braces; and a plurality of straight tubing pieces for connecting the corner braces, side braces and top brace, the plurality of straight tubing pieces extending between associated ones of the corner braces and the side braces, and between the top brace and each of the side braces; wherein each corner brace comprises three components welded together and consists of a horizontal, a vertical, and a diagonal to form a triangular substructure.

2. A frame assembly according to claim 1, wherein the corner braces, side braces, the beam, the top brace, and the plurality of straight tubing pieces are formed from square, galvanized steel hollow tubing comprising a combination of 2½-inch, 14-gage tubing, and 2¼-inch, 12-gage tubing, and the frame assembly is formed by sliding smaller components into larger hollow components and securing them together with one of welding and fasteners.

3. A frame assembly according to claim 1, wherein the frame assembly forms a triangular A-frame, the corner braces are identical to each other, the side braces are identical to each other, respectively, but oriented in opposite directions.

4. A frame assembly according to claim 1, wherein a shape of the top brace is one of triangular and semi-circular.

5. A frame assembly according to claim 1, wherein each horizontal has an end that extends beyond an intersection with the vertical, and each diagonal has an end that extends beyond an intersection with the vertical.

6. A frame assembly according to claim 5, wherein a floor straight tubing piece extends between and is connected to the horizontals of the corner braces.

7. A frame assembly according to claim 1, wherein each side brace comprises four components that are welded together and consists of a diagonal, a vertical, a top, and a bottom, with the top and bottom extending between the diagonal and the vertical, the diagonal extending approximately equidistant beyond both the top and the bottom, and the top and the bottom extending beyond respective intersections with the vertical.

8. A frame assembly according to claim 7, wherein the beam comprises upper and lower horizontals that are welded to a plurality of verticals, the upper horizontal is shorter than the lower horizontal, the upper horizontal inserts into the tops of the side braces, and the lower horizontal inserts into the bottoms of the side braces.

9. A frame assembly according to claim 1, further comprising a pair of second side braces located above and connected to the side braces with straight tubing, and a second beam located above the beam and extending between and connected to the pair of second side braces, and the top brace is connected to the second side braces with straight tubing rather than to the side braces.

10. A frame assembly according to claim 1, wherein the top brace comprises diagonals that are welded to form a hinge edge at upper ends thereof, a horizontal is welded between the diagonals, and is cut between the diagonals to define cut portions, and a sleeve is located over the cut such that the sleeve straddles the cut portions of the horizontal and is welded to the horizontal.

11. A frame assembly according to claim 1, wherein the side braces comprise side beams, each side beam having inner and outer longitudinals joined to a plurality of laterals, the side beams extending diagonally between respective ones of the corner braces and the beam, the beam comprising a horizontal beam feature extending between two diagonals.

12. A frame assembly according to claim 1, wherein the straight tubing comprises smaller tubing located inside hollow larger tubing to define inner and outer sleeves that extend diagonally between the corner braces and the side braces, and the inner sleeve extends all the way to the top brace.

13. A frame assembly, comprising:

a pair of corner braces;

a pair of side braces, each of the side braces being associated with and located adjacent and above respective ones of the corner braces;

a beam extending horizontally between and connecting the side braces;

a top brace located adjacent and above the side braces and the beam opposite the corner braces;

a plurality of straight tubing pieces for connecting the corner braces, side braces and top brace, the plurality of straight tubing pieces extending between associated ones of the corner braces and the side braces, and between the top brace and each of the side braces; wherein each side brace comprises four components that are welded together and consists of a diagonal, a vertical, a top, and a bottom, with the top and bottom extending between the diagonal and the vertical, the diagonal extending approximately equidistant beyond both the top and the bottom, and the top and the bottom extending beyond respective intersections with the vertical.

14. A frame assembly according to claim 13, wherein the corner braces, side braces, the beam, the top brace, and the plurality of straight tubing pieces are formed from square, galvanized steel hollow tubing comprising a combination of 2½-inch, 14-gage tubing, and 2¼-inch, 12-gage tubing, and the frame assembly is formed by sliding smaller components into larger hollow components and securing them together with one of welding and fasteners.

15. A frame assembly according to claim 13, wherein the frame assembly forms a triangular A-frame, the corner braces are identical to each other, the side braces are identical to each other, respectively, but oriented in opposite directions.

16. A frame assembly according to claim 13, wherein a shape of the top brace is one of triangular and semi-circular.

17. A frame assembly according to claim 13, wherein each corner brace comprises three components welded together and consists of a horizontal, a vertical, and a diagonal to form a triangular substructure, each horizontal having an end that extends beyond an intersection with the vertical, and each diagonal having an end that extends beyond an intersection with the vertical.

18. A frame assembly according to claim 17, wherein a floor straight tubing piece extends between and is connected to the horizontals of the corner braces.

19. A frame assembly according to claim 13, wherein the beam comprises upper and lower horizontals that are welded to a plurality of verticals, the upper horizontal is shorter than the lower horizontal, the upper horizontal inserts into the tops of the side braces, and the lower horizontal inserts into the bottoms of the side braces.

20. A frame assembly according to claim 13, wherein the top brace comprises diagonals that are welded to form a hinge edge at upper ends thereof, a horizontal is welded between the diagonals, and is cut between the diagonals to define cut portions, and a sleeve is located over the cut such that the sleeve straddles the cut portions of the horizontal and is welded to the horizontal.

* * * * *